US011987963B2

(12) United States Patent
Skaloud et al.

(10) Patent No.: US 11,987,963 B2
(45) Date of Patent: May 21, 2024

(54) SHOWER ASSEMBLY AND METHOD OF ATTACHING SUCH A SHOWER ASSEMBLY

(71) Applicant: Deburr LLC, Seattle, WA (US)

(72) Inventors: Brett Skaloud, Seattle, WA (US); Jeffrey K Feiereisen, New York, NY (US)

(73) Assignee: Deburr LLC, Seattle, WA (US)

( * ) Notice: Subject to any disclaimer, the term of this patent is extended or adjusted under 35 U.S.C. 154(b) by 247 days.

(21) Appl. No.: 17/544,563

(22) Filed: Dec. 7, 2021

(65) Prior Publication Data

US 2022/0251811 A1 Aug. 11, 2022

Related U.S. Application Data

(60) Provisional application No. 63/148,417, filed on Feb. 11, 2021.

(51) Int. Cl.
*E03C 1/02* (2006.01)
*E03C 1/04* (2006.01)

(52) U.S. Cl.
CPC ..... *E03C 1/023* (2013.01); *E03C 1/0408* (2013.01)

(58) Field of Classification Search
CPC ..... E03C 1/023; E03C 1/0408; E03C 1/06; B05B 15/628; B05B 1/18
See application file for complete search history.

(56) References Cited

U.S. PATENT DOCUMENTS

| | | | | | |
|---|---|---|---|---|---|
| 2,697,839 | A * | 12/1954 | Jackson | E03C 1/06 | 4/615 |
| 3,913,839 | A * | 10/1975 | Wilson | E03C 1/06 | 239/269 |
| 4,545,083 | A * | 10/1985 | Searson | E03C 1/06 | 4/596 |
| 5,564,139 | A * | 10/1996 | Shorr | A47K 3/283 | 4/601 |
| 5,692,252 | A | 12/1997 | Zwezdaryk | | |
| 5,799,346 | A * | 9/1998 | Tiernan | A47K 3/28 | 285/31 |
| 9,095,861 | B2 | 8/2015 | Costello | | |
| 9,242,259 | B2 * | 1/2016 | Jeronimus | B05B 7/0408 | |
| 2006/0236451 | A1 | 10/2006 | Freedmann | | |

* cited by examiner

*Primary Examiner* — Qingzhang Zhou
(74) *Attorney, Agent, or Firm* — Henry M. Felereisen LLC

(57) ABSTRACT

A shower assembly includes a telescoping rod assembly for placement between opposing walls. The rod assembly includes an outer rod having opposite open ends and a spring-biased inner rod mounted inside the outer rod for axial movement in relation to the outer rod such as to allow adjustment of an axial length of the rod assembly. A control valve can be attached to a water-supply line for controlling discharge of water from the one. A tubular member having one end connected to the valve and another end enters a valve-proximate one of the open ends of the outer rod. A primary shower head is connected to the other end of the tubular member at a location distal to the valve-proximate one of the open ends.

13 Claims, 6 Drawing Sheets

SHOWER ASSEMBLY AND METHOD OF ATTACHING SUCH A SHOWER ASSEMBLY

CROSS-REFERENCES TO RELATED APPLICATIONS

This application claims the benefit of prior filed U.S. provisional Application No. 63/148,417, filed Feb. 11, 2021, pursuant to 35 U.S.C. 119(e).

BACKGROUND OF THE INVENTION

The present invention relates in general to a shower assembly and to a method of attaching such a shower assembly to an existing shower head.

The following discussion of related art is provided to assist the reader in understanding the advantages of the invention, and is not to be construed as an admission that this related art is prior art to this invention.

Heretofore, extensive renovations, including cumbersome plumbing works are required to improve a shower experience by making the shower head height adjustable or complementing a single shower head with additional spray heads, for example.

It would therefore be desirable and advantageous to address this problem and to obviate other prior art shortcomings.

SUMMARY OF THE INVENTION

According to one aspect of the invention, a shower assembly includes a telescoping rod assembly for placement between opposing walls, said rod assembly including an outer rod having opposite open ends and a spring-biased inner rod mounted inside the outer rod for axial movement in relation to the outer rod such as to allow adjustment of an axial length of the rod assembly, a control valve attachable to a water-supply line for controlling discharge of water from the line, a tubular member having one end connected to the valve and another end, said tubular member configured to enter a valve-proximate one of the open ends of the outer rod, and a primary shower head connected to the other end of the tubular member at a location distal to the valve-proximate one of the open ends.

According to another aspect of the invention, a method includes detaching an existing shower head from a water-supply line, attaching a telescoping rod assembly between two opposite walls, attaching a primary shower head to the rod assembly at a location distal to the water-supply line so as to point toward a user intending to take a shower, connecting a control valve to the water-supply line, and connecting one end of a tubular member, exiting from inside the rod assembly via an open end of the rod assembly to the outside, to one outlet of the control valve for conducting water to the primary shower head.

A shower assembly according to the invention enables simple modification of an existing shower head that projects out from a wall by adding another shower head. This enhances the shower experience as water jets can be dispensed from two sides.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
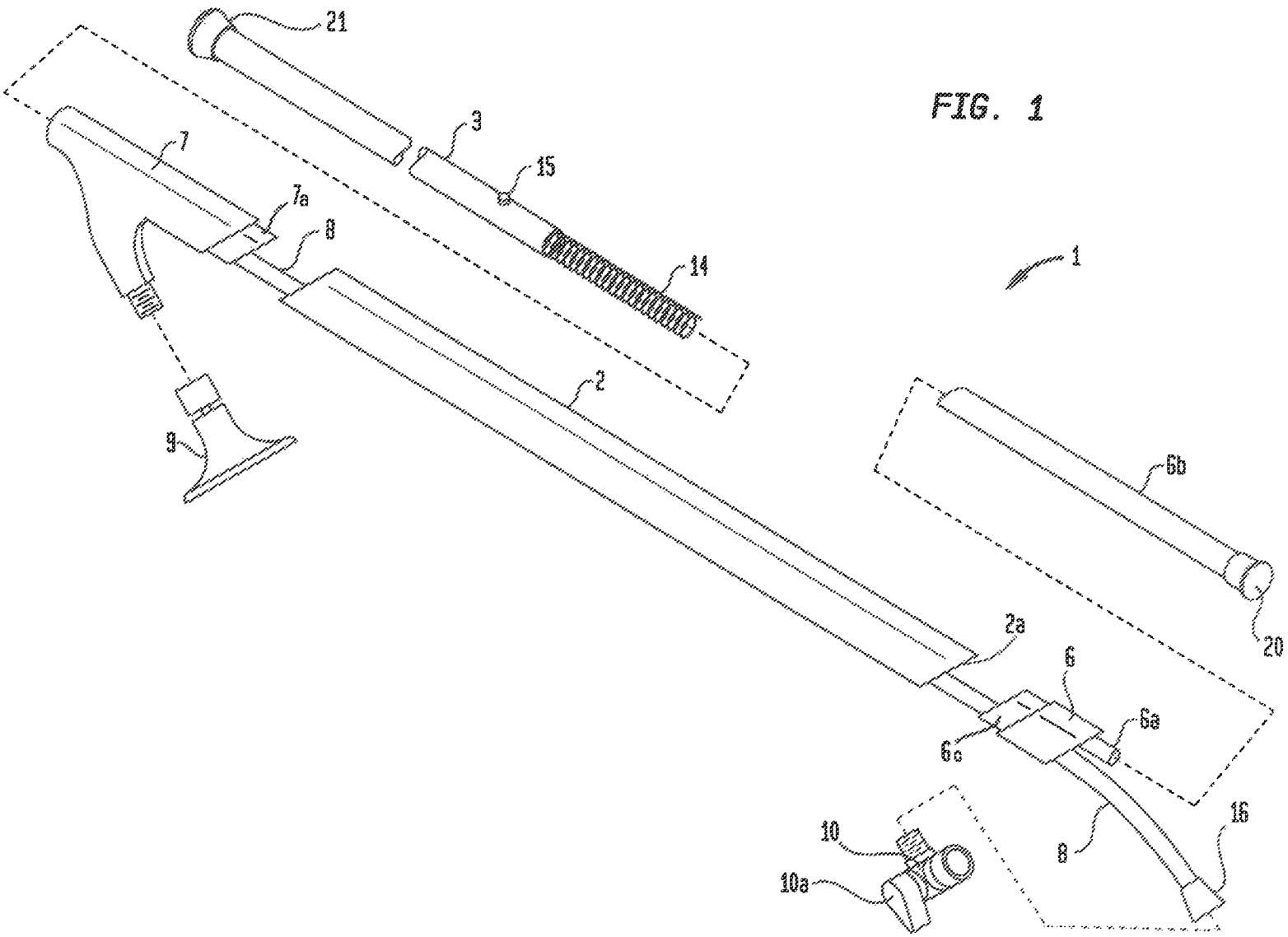
FIG. 1 is an exploded view of one embodiment of a shower assembly according to the invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments may be illustrated by graphic symbols, phantom lines, diagrammatic representations and fragmentary views. In certain instances, details which are not necessary for an understanding of the present invention or which render other details difficult to perceive may have been omitted.

To ensure clarity, it is necessary to establish the definition of several important terms and expressions that will be used throughout this disclosure.

The term "rod" or "rod assembly" is used in the description in a generic sense as relating to any shape suitable to enable an inner member to move in relation to an outer member.

The term "tubular member" relates to an enclosed structure, suitable for water to flow through, such as a pipe or hose, and can be flexible or rigid.

The indefinite article "a" is to be understood as relating to one or more, unless specifically defined in the singular.

Figure 2:
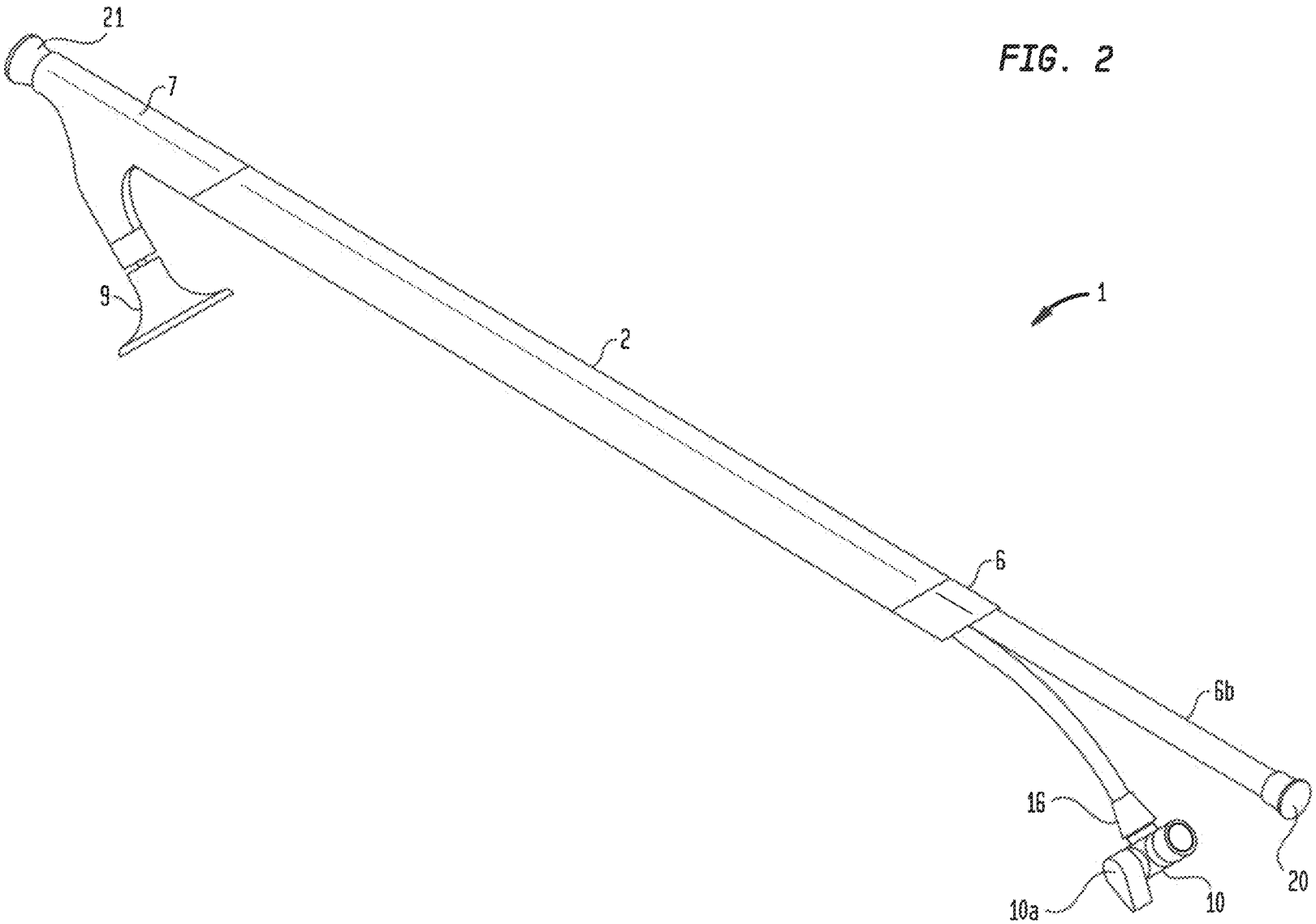
FIG. 2 is a schematic perspective illustration of the shower assembly of FIG. 1 in an assembled state.

Turning now to the drawing, and in particular to FIGS. 1 and 2, there are shown two views of one embodiment of a shower assembly according to the invention, generally designated by reference numeral 1, with FIG. 1 depicting an exploded view of the shower assembly 1 and with FIG. 2 depicting a schematic perspective illustration of the shower assembly 1, when assembled. The shower assembly 1 includes a telescoping or length adjustable hollow rod assembly which includes an outer rod 2 and an inner rod 3 which extends axially inside the outer rod 2 and is length-adjustable so that the rod assembly can be secured between opposing walls 4, 5 (FIG. 3) of a shower stall, Although FIGS. 1 and 2 show a straight configuration of the rod assembly, it is equally conceivable to have a rod assembly of curved configuration.

The outer rod 2 is attached at one end to a coupler 6, e.g. via a press-fit connection or adhesive connection. The coupler 6 has a finger-like projection 6*a* for connection to a rod 6*b*. In the exemplified embodiment of FIG. 1. the press-fit connection is realized by a connection piece 6*c* which juts out of reduced diameter from the coupler 6 on a side thereof opposite to the projection 6*a*. The coupler 6 and the rod 6*b* may, of course, be made of one piece. The coupler-distal end of the rod 6*b* has attached thereon an end cap 20 for placement of the shower assembly 1 against the wall 4, as shown by way of example in FIG. 3.

The other coupler-distal end of the outer rod 2 is connected to an elbow 7, e.g. via a press-fit connection or adhesive connection. In the exemplified embodiment of FIG. 1, the press-fit connection is realized by a connection piece 7*a* which juts out of reduced diameter from the elbow 7 on a side facing the outer rod 2. A further end cap 21 is attached to the inner rod 3 for placement of the shower assembly 1 against the wall 5, as shown by way of example in FIG. 3.

The shower assembly 1 further includes a tubular member 8 which enters the outer rod 2 at a valve-proximate open end 2*a* in the area of the coupler 6 and Is in fluid communication with a primary shower head 9 which is connected to the elbow 7, e.g. via a threaded engagement. A coupler-distal end of the tubular member 8 is connected to an outlet of a 3-way control valve 10 which is attached to a water-supply line 11 through which water is supplied from a water source to the shower assembly 1. The control valve 10 is connected to the tubular member 8, by way of example, via a suitable threaded collar 16.

Figure 3:
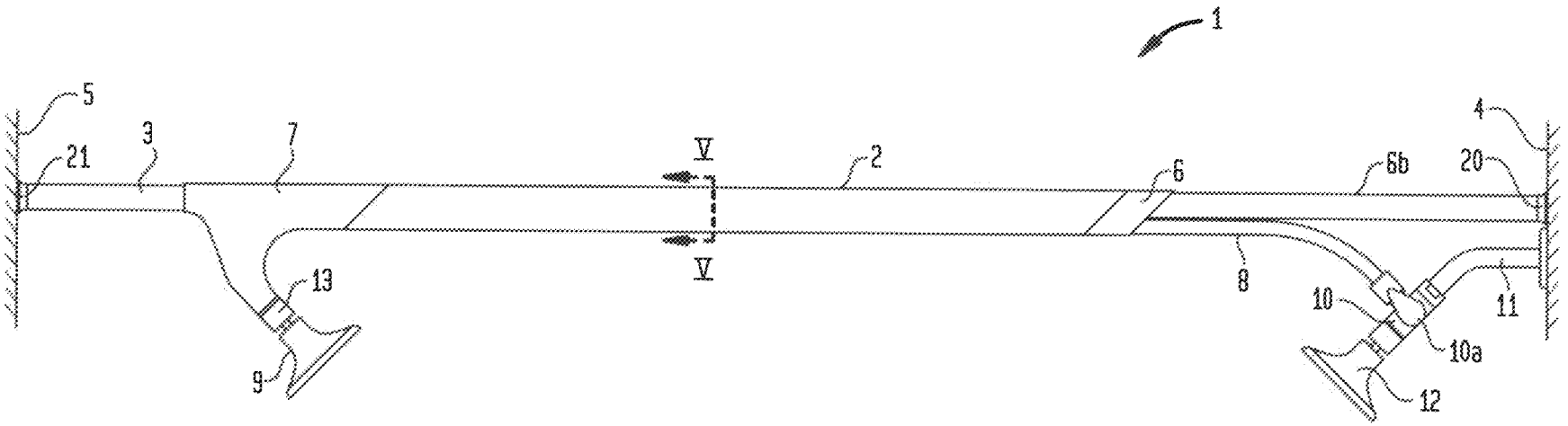
FIG. 3 is a schematic illustration of the shower assembly of FIG. 1 supplemented with an existing shower head.

Referring now to FIG. 3, there is shown a schematic illustration of the shower assembly 1 supplemented with an existing or secondary shower head 12. When installing the shower assembly 1, the existing shower head 12 is detached from the water-supply line 11 to allow a user to attach the control valve 10 to the water-supply line 11. The existing shower head 12 can then be attached to another outlet of the control valve 10, as shown in FIGS. 3 and 4.

The control valve 10 has a handle 10*a* to control a flow of water from a water source and opening a respective valve to start the flow of water, The control valve 10 is switchable by a user so that the flow of water can be adjusted between the shower heads 9 and 12 to the desires of the user.

Advantageously, the tubular member 8 is made of a material that is flexible enough to allow a user to reposition the shower assembly 1 in a vertical direction between the opposing walls 4, 5. In this way, the shower assembly 1 can be height-adjusted to the size of the user.

Figure 4:
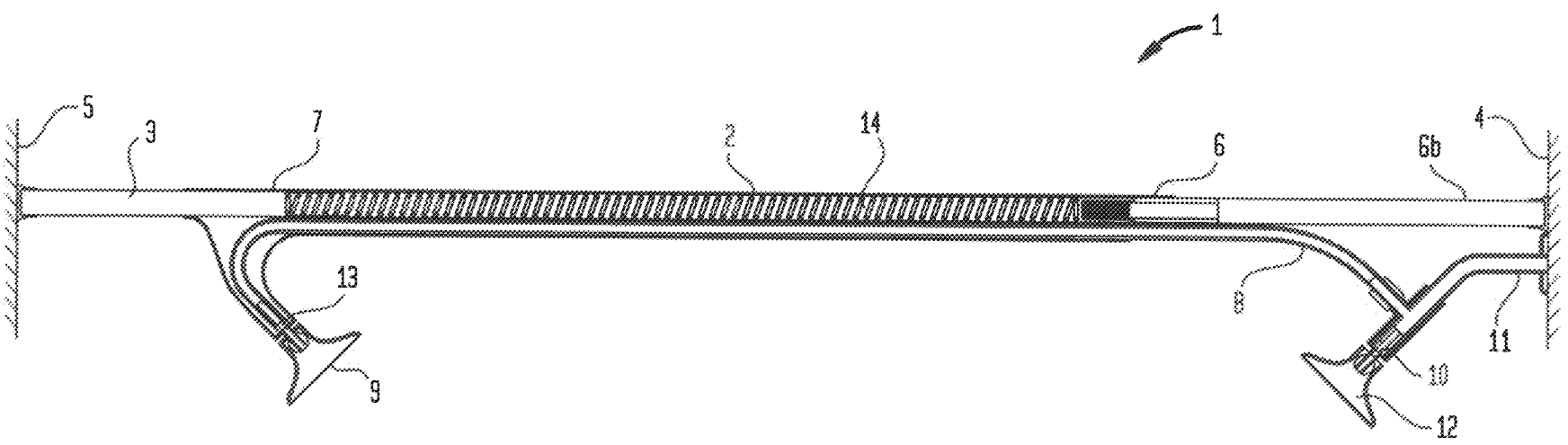
FIG. 4 is a longitudinal section of the shower assembly of FIG. 2.

Referring now to FIG. 4, there is shown a longitudinal section of the shower assembly 1. The primary shower head 9 is connected to a fitting 13 received in the elbow 7. FIG. 4 also shows an example of implementing a telescoping capability or length adjustment of the rod assembly. Persons skilled in the art will understand that there are various ways of implementing this telescoping capability or length adjustment of the rod assembly. In the non-limiting example of FIG. 4, provision is made for a spring 14 and a pin 15 (FIG. 1). The spring 14 is fixed inside the outer rod 2 and extends within the inner rod 3. Twisting of the inner rod 3 causes the pin 15 to rotate along the spring 14 outwardly or inwardly. As a result, the inner rod 3 moves in or out in relation to the outer rod 2. The position of the inner rod 3 is hereby held in place by the pin 15 upon compression between walls 4, 5. Of course, this configuration is shown by way of example only, and other configurations which generally follow the concepts outlined here are considered to be covered by this disclosure.

FIG. 4 further shows by way of example the tubular member 8 extending through the outer rod 2 for connection to the fitting 13 to which the primary shower head 9 is attached. Of course, while not shown in detail, the tubular member 8 may feed into a channel which is bounded by the outer rod 2 and the inner rod 3 and is in fluid communication with the primary shower head 9. In this embodiment, the tubular member 8 ends and is sealingly received within the coupler 6.

The outer rod 2 and the inner rod 3 are normally made of metal, e.g. steel, whereas the coupler 6 and the elbow 7 can be made of plastic. Connections between the rod assembly and the coupler 6 and the elbow 7 may be realized in various ways, e,g, via a press-fit connection or adhesive connection. The elbow 7 can be made of a plastic material that is flexible and yet rigid enough so that the elbow 7 and thus the primary shower head 9 can be rotated to enable a user to point the primary shower head between a substantially 45° angle toward the user, as shown in FIG. 4, and a vertical orientation toward the user to serve as rain head. Of course, the primary shower head 9 may also be rotatably mounted to the fitting 13 to reorient the position of the primary shower head 9.

Figure 5:
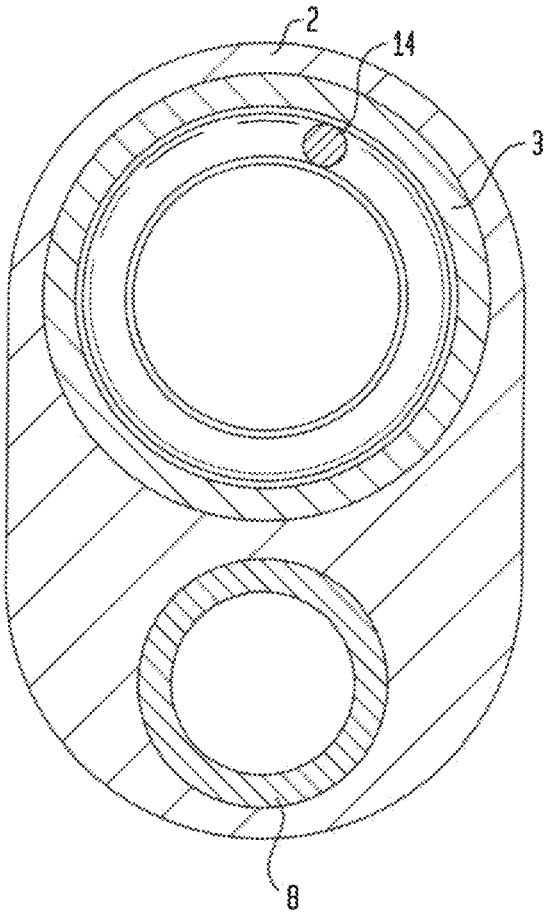
FIG. 5 is a cross sectional of the shower assembly, taken along the section line V-V in FIG. 3.

FIG. 5 is a cross sectional of the shower assembly 1, taken along the section line V-V in FIG. 3, to illustrate the positional relationship between outer and inner rod 2, 3, spring 14 and tubular member 8.

Figure 6:
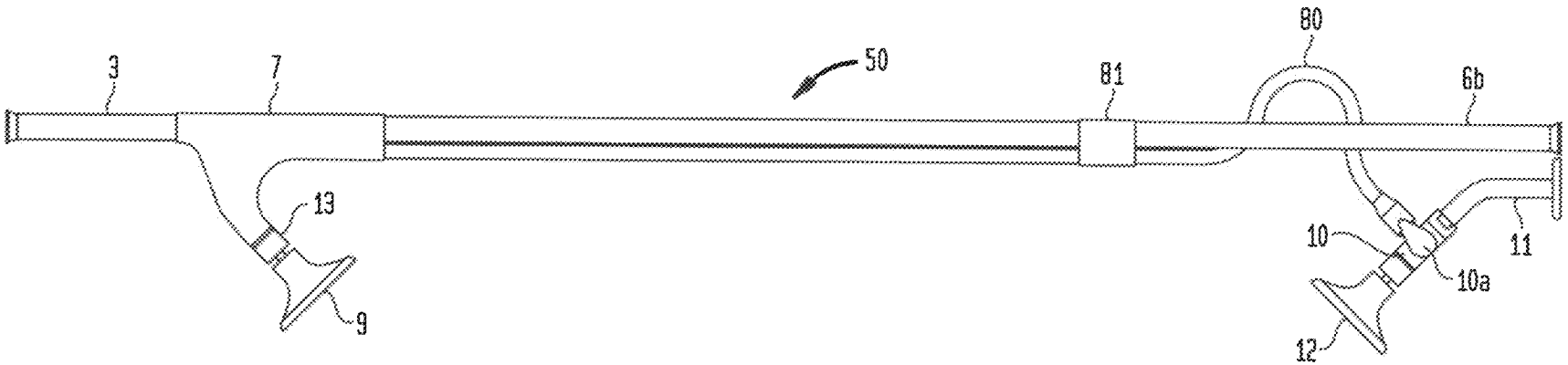
FIG. 6 is a schematic illustration of another embodiment of a shower assembly according to the invention.

Referring now to FIG. 6, there is shown a schematic illustration of another embodiment of a shower assembly according to the invention, generally designated by reference numeral 50. Parts corresponding with those in FIGS. 1 to 4 are denoted by identical reference numerals and not explained again. The description below will center on the differences between the embodiments. In this embodiment, provision is made for a tubular member 80 which extends in parallel relation outside the rod assembly and is connected to the outer rod 2 by a clip or clamp 81. The tubular member 80 is sized to extend through the elbow 7 for attachment to the primary shower head 9 and is also advantageously made of a material that is flexible enough to allow a user to reposition the shower assembly 1 up and down in a vertical direction between the opposing walls 4, 5.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A shower assembly, comprising:

a telescoping rod assembly for placement between opposing walls, said rod assembly including an outer rod having opposite open ends and a spring-biased inner rod mounted inside the outer rod for axial movement in relation to the outer rod such as to allow adjustment of an axial length of the rod assembly;

a control valve attachable to a water-supply line for controlling discharge of water from the water-supply line;

a single-piece tubular member having one end connected to the valve and another end, said tubular member configured to enter a valve-proximate one of the open ends of the outer rod and to extend inside the outer rod along an entire length of the outer rod to a valve-distal one of the open ends in parallel relation to the inner rod; and a primary shower head connected to the other end of the tubular member at a location distal to the valve proximate one of the open ends, wherein the tubular member is flexible and has a portion extending between the control valve and the valve-proximate one of the open ends of the outer rod, said portion of the flexible tubular member being sized to allow height adjustment of the rod assembly.

2. The shower assembly of claim 1, wherein the inner rod and the tubular member extend in substantial parallel relationship within the outer rod.

3. The shower assembly of claim 1, wherein the tubular member is configured to be stretchable or compressible to assist in the height adjustment of the rod assembly.

4. The shower assembly of claim 1, further comprising a secondary shower head connectable to the control valve, said control valve being switchable by a user so that a flow of water is adjustable to flow to both the primary and secondary shower heads or to each of the primary and secondary shower heads alone.

5. The shower assembly of claim 1, wherein the outer rod includes an outwardly projecting elbow at the location distal to the valve-proximate one of the open ends, said other end of the tubular member extending in the elbow for attachment to the primary shower head.

6. The shower assembly of claim 5, wherein the outer rod and the elbow form a unitary structure.

7. The shower assembly of claim 1, wherein the primary shower head is detachably connected to the other end of the tubular member.

8. The shower assembly of claim 7, wherein the primary shower head is connected in one piece with the elbow.

9. The shower assembly of claim 1, wherein the primary shower head is rotatably attached to the rod assembly to enable a user to point the primary shower head between a substantially 45° angle toward the user and a vertical orientation toward the user to serve as rain head.

10. A method, comprising:

detaching an existing shower head from a water-supply line;

attaching a telescoping rod assembly between two opposite walls;

attaching a primary shower head to the rod assembly at a location distal to the water-supply line so as to point toward a user intending to take a shower;

connecting a control valve to the water-supply line;

connecting one end of a flexible single-piece tubular member, exiting from inside the rod assembly via an open end of the rod assembly to the outside with a portion thereof, to one outlet of the control valve for conducting water to the primary shower head;

sizing the portion of the flexible tubular member to enable height adjustment of the rod assembly; and attaching the existing shower head or another shower head to another outlet of the control valve to enable the user to switch the control valve for adjusting a flow of water to flow to both the primary shower head and existing or other shower head or to each of the primary shower head and existing or other shower head alone.

11. The method of claim 10, further comprising enabling the primary shower head to rotate between one position in which the primary shower head is angled at a substantially 45° angle toward the user and another position in which the primary shower head is straightened to extend a vertical orientation toward the user to serve as rain head.

12. The shower assembly of claim 1, further comprising a coupler including a connection piece which juts out of reduced diameter from the coupler for press-fit connection into the outer rod.

13. The shower assembly of claim 1, further comprising an elbow including a connection piece which juts out of reduced diameter from the elbow for press-fit connection into the outer rod.

* * * * *